United States Patent [19]

Viehrig et al.

[11] 4,164,371

[45] Aug. 14, 1979

[54] PHOTOGRAPHIC DEVELOPING MACHINE

[75] Inventors: Wolfgang Viehrig; Werner Sperber, both of Munich, Fed. Rep. of Germany

[73] Assignee: AGFA-Gavaert, A.G., Leverkusen, Fed. Rep. of Germany

[21] Appl. No.: 953,758

[22] Filed: Oct. 23, 1978

[30] Foreign Application Priority Data

Oct. 28, 1977 [DE] Fed. Rep. of Germany ..... 2748506

[51] Int. Cl.[2] ..... G03D 3/13

[52] U.S. Cl. ..... 354/312; 354/307; 354/319; 354/331

[58] Field of Search ..... 354/277, 297, 307, 310, 354/311, 312, 313, 314, 319, 320, 321, 322, 332, 338, 331; 352/72, 75, 76, 78 R; 134/64 P, 122 P; 242/197, 71.1, 71.7; 226/92

[56] References Cited

U.S. PATENT DOCUMENTS

| | | | |
|---|---|---|---|
| 3,195,438 | 7/1965 | Woodcock | 354/321 |
| 3,568,587 | 3/1971 | Laval | 354/297 |
| 3,627,227 | 12/1971 | Foor | 352/75 |
| 3,720,408 | 3/1973 | Horn | 354/319 |
| 3,776,483 | 12/1973 | Reitter | 242/71.1 |
| 3,810,568 | 5/1974 | Kwiatkowski | 354/310 |
| 4,067,034 | 1/1978 | Kwiatkowski | 354/307 |

*Primary Examiner*—L. T. Hix
*Assistant Examiner*—Alan Mathews
*Attorney, Agent, or Firm*—Peter K. Kontler

[57] ABSTRACT

Apparatus for introducing webs of exposed photographic paper into a developing machine has a feed table with one or more channels communicating with a chamber below the table. The effective length of each channel can be varied by a plate-like selector which is slidable on the table and has several apertures each movable into register with the respective channel to define with the latter a passage for the leader of a web which is stored in a cassette on the table and is about to be introduced into the chamber for attachment to a threading strip which advances the leader through the tanks of the developing machine. The selectors can be locked in selected positions by discrete detent devices and have indicia to indicate their positions with respect to the feed table. A partition is insertable between two neighboring selectors to close the median part of a relatively long channel whereby the outer parts of such longer channel constitute two shorter channels whose effective length can be changed by appropriate shifting of the corresponding selectors.

13 Claims, 3 Drawing Figures

PHOTOGRAPHIC DEVELOPING MACHINE

BACKGROUND OF THE INVENTION

The present invention relates to photographic developing machines, and more particularly to improvements in machines which are especially suited for development of exposed photographic paper. Still more particularly, the invention relates to improvements in machines for processing rolls of exposed photographic paper which are confined in containers or cassettes (hereinafter called cassettes).

It is known to place cassettes with rolls of convoluted exposed photographic paper therein onto a feed table which is located in a darkroom and through which the leader of the web of convoluted paper is fed to a light-tightly sealable chamber for connection to a strip-shaped threading element or tape which advances the leader through the tanks of a developing machine. As a rule, the feed table is formed with an elongated channel which communicates with the chamber and through which the leader of a roll of convoluted paper must advance toward and into the chamber. Since a modern developing machine is designed to simultaneously develop several webs of photographic paper, the feed table has several channels so that two or more webs can be conveyed at the same time. A drawback of such machines is that each channel of the feed table only permits the passage of a web having a predetermined width. Thus, if the machine is to simultaneously process several webs of different widths, the respective cassettes must be placed in corresponding positions so as to insure that the webs which are stored therein can pass through the neighboring channels of the feed table. The design of the feed table is such that a cassette for a relatively narrow web cannot be mounted adjacent a channel which can permit the passage of a wider web or vice versa. Therefore, the versatility of conventional machines is rather low, and this can be overcome only by resorting to several feed tables or by using very large feed tables with an inordinately large number of channels.

Laboratory equipment resembling the just discussed machines is available on the market under the trade name LABOMATOR 5 ZOLL (manufactured by the assignee of the present application).

OBJECTS AND SUMMARY OF THE INVENTION

An object of the invention is to provide a developing machine for exposed photographic paper webs or the like with a novel and improved apparatus which can define one or more passages of varying width in order to enable each and every passage to allow for controlled introduction of the leaders of webs of varying widths into the range of devices which advance the leaders through the tanks of the developing machine.

Another object of the invention is to provide a versatile apparatus wherein at least one passage can be converted for threading of wider or narrower webs therethrough and wherein such conversion takes up little time.

A further object of the invention is to provide an apparatus of the above outlined character which can be incorporated in or combined with existing developing machines for wide, extra wide, narrow or medium wide webs of exposed photographic paper which is confined in cassettes.

An additional object of the invention is to provide an apparatus wherein the selected length of a passage for introduction of a web of given width remains constant unless the attendant desires to change such length.

Another object of the invention is to provide the apparatus with novel and improved means for facilitating immediate determination of the selected length of a passage.

The invention is embodied in a machine for developing webs of exposed photographic paper or the like which have different widths and are confined in cassettes. More particularly, the invention is embodied in an apparatus for positioning cassettes preparatory to withdrawal of webs from their interior. The apparatus comprises a feed table having at least one elongated channel, means defining a chamber which is disposed at one side (e.g., at the underside) of the feed table and communicates with the channel, and a preferably plate-like selector adjacent to the other side of the feed table and having a plurality of differently dimensioned apertures in the form of slots and/or cutouts or notches. The selector is movable between a plurality of positions in each of which a different aperture registers with the channel to define with the channel a passage through which a web having one of several widths can be advanced from the interior of the respective cassette into the chamber wherein the leader of the web is attached to a threading strip or tape for advancement through the developing unit.

The apparatus preferably further comprises means for preventing penetration of light into the chamber via channel in the feed table in the absence of a properly positioned cassette on the feed table. Furthermore, the apparatus preferably comprises guide means in the form of plates or the like provided on the feed table and serving to confine the selector to movements in predetermined directions, e.g., to reciprocatory movements between the aforementioned positions.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 2 is a similar perspective view but showing the selector in a different position in which the selector cooperates with the feed table to define a longer passage for relatively wide webs of photographic paper or the like.

DESCRIPTION OF THE PREFERRED EMBODIMENTS

Figure 1:
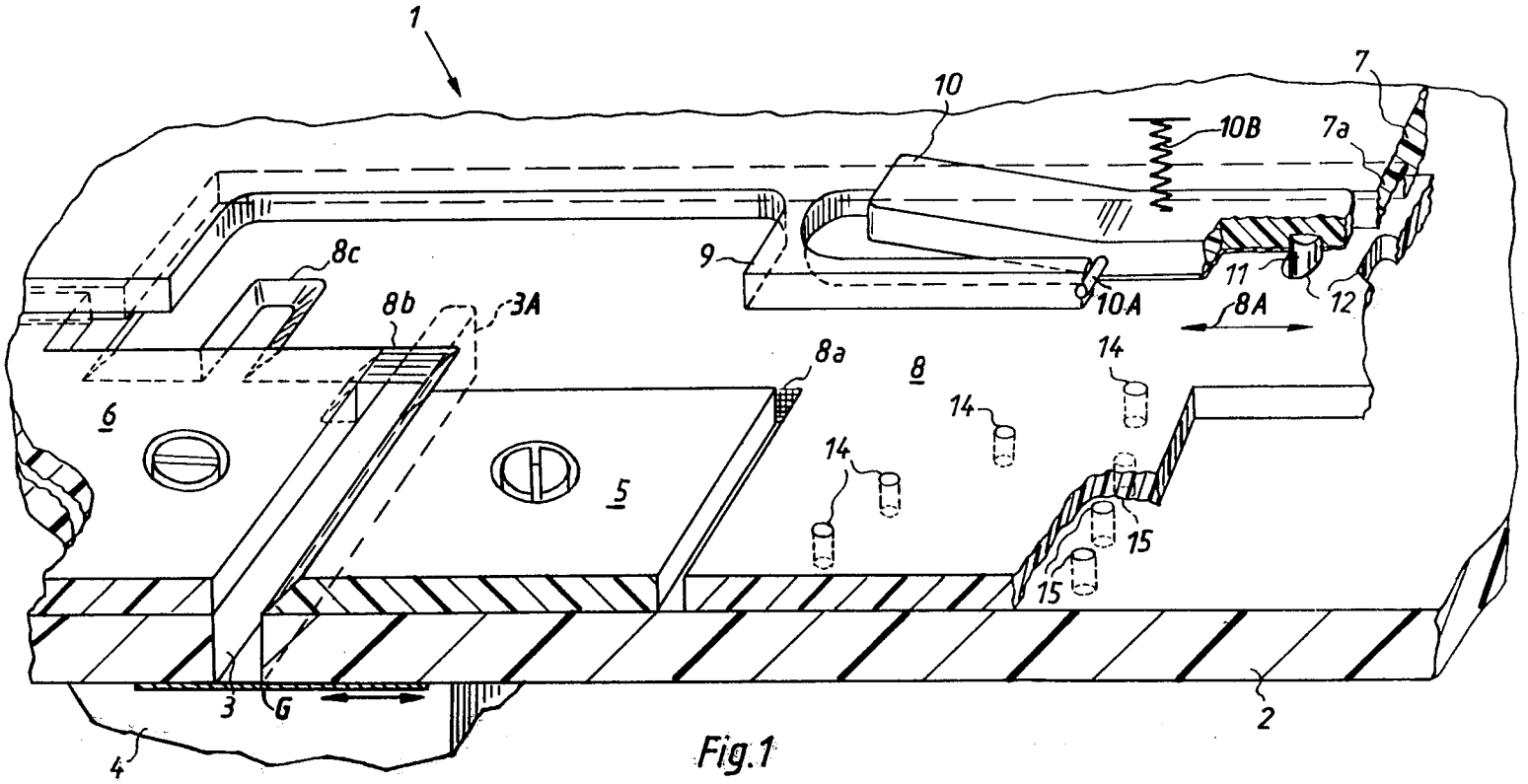
FIG. 1 is a fragmentary perspective view of an apparatus which embodies one form of invention and comprises a single selector, the selector being shown in that position in which it cooperates with the feed table to define a passage of medium length.
Figure 2:
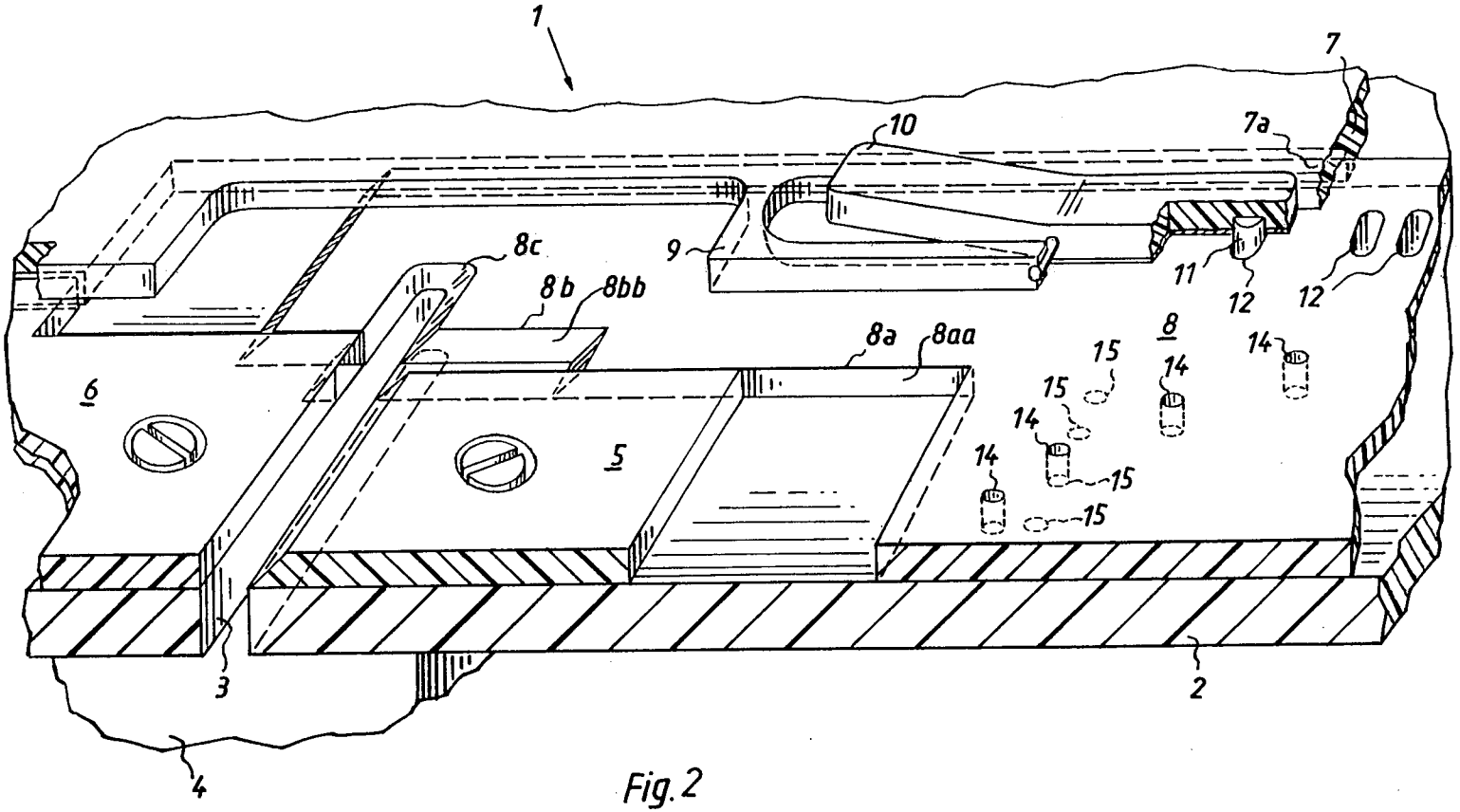
Figure 3:
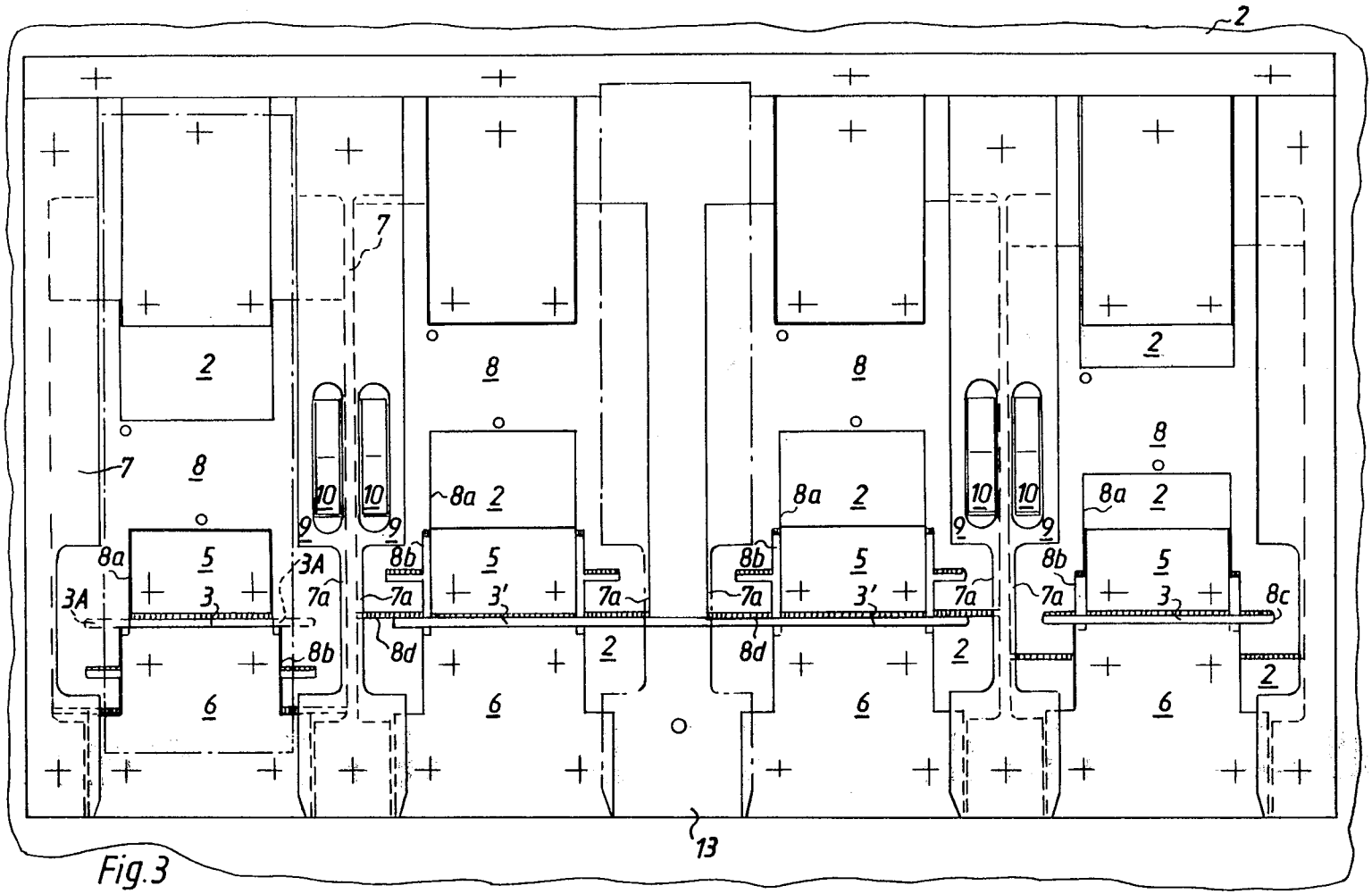
FIG. 3 is a schematic plan view of a modified apparatus with several plate-like selectors and with a channel which can be used to admit into the chamber a web of maximum width.

Referring to FIGS. 1 and 2, there is shown an apparatus 1 forming part of a developing machine for photographic paper which is stored in the form of rolls and is confined in cassettes C (one shown in the left-hand portion of FIG. 3). The drawing merely shows that portion of the developing machine wherein the paper rolls are processed prior to admission into the first tank of the developing unit proper. The illustrated apparatus 1 comprises a so-called feed table 2 with an elongated channel 3 through which the leader of a web of convoluted exposed but underdeveloped photographic paper must pass on its way into a chamber 4 which is normally sealed against entry of light and wherein the leader of a web is or can be attached to a threading strip or pull tape. As explained above, the strip or tape serves to advance the leader through the tanks of the developing unit. As a rule, the leader of a web is separably attached to the threading strip by a clamp or by means of another suitable fastener which insures that the leader will follow the strip along a predetermined path so as to insure adequate processing of exposed images on the paper web. Reference may be had to commonly owned U.S. Pat. No. 4,067,034 granted Jan. 3, 1978 to Kwiatkowski. The disclosure of this patent is incorporated herein by reference. The utilization of a clamp is but one of several acceptable techniques which insure that the leader of a web will be properly threaded through the developing unit.

The outer or upper side of the feed table 2 supports plate-like inner guide members 5 and 6 and outer plate-like guide members 7 (see also FIG. 3). The outer guide members 7 flank a mobile bifurcated plate-like passage selector 8 which flanks and is guided by the members 5 and 6 so that it can assume any one of several predetermined positions in each of which the selector 8 cooperates with the feed table 2 to define a passage having a different length. In other words, and assume that the selector 8 is movable between three different positions (this is actually shown in FIGS. 1 and 2), the selector cooperates with the feed table to define a relatively short passage for a narrow paper web in the first position thereof, a longer passage in the second position, and a still longer passage in the third position. The outer guide members 7 have overhanging ledges 7*a* which overlie the respective marginal portions of the selector 8 so that the latter is confined to movements in directions indicated by the double-headed arrow 8A. The underside of the selector 8 rests on the upper side of the feed table 2. The ledges 7*a* further constitute or form part of labyrinth seals which prevent penetration of light into the chamber 4 at the underside of the feed table 1. The upper side of the selector 8 can be exposed to daylight to facilitate the application of cassettes C for rolls of paper webs.

The selector 8 has three apertures 8*a*, 8*b* and 8*c* each of which can be brought into register with the channel 3 to form with a portion of or with the entire channel a passage having an effective length corresponding to one of three different paper web widths. The arrangement is preferably such that the surfaces which bound the apertures 8*a* to 8*c* can also perform certain other functions, especially of cooperating with the guide members to insure predictable and reproducible movements of the selector 8 to any one of the three positions. As shown in FIGS. 1 and 2, one (8*aa*) of the surfaces bounding the aperture 8*a* can slide along the adjacent edge face of the inner guide member 5, and one (8*bb*) of the surfaces bounding the aperture 8*b* can slide along one edge face of the guide member 6. The length of the aperture 8*a*, as considered in the direction of arrow 8A, exceeds the corresponding dimension of the guide member 5 by the desired width of the passage when the latter is defined by the channel 3 and a portion of the aperture 8*a*. The aperture 8*b* extends outwardly from the left-hand end of the aperture 8*a*, as viewed in FIG. 1 or 2, and moves into register with the channel 3 when the selector 8 is moved from the position of FIG. 2 to the position of FIG. 1, i.e., in a direction to the left. In FIG. 2, the channel 3 registers with the aperture 8*c*. The aperture 8*c* is a slot whose width equals or approximates the width of the channel 3. If the selector 8 is moved beyond the position of FIG. 1 (in a direction to the left), the left-most portion of the aperture or cutout 8*a* registers with the channel 3. In each of the three positions of the selector 8, a different cassette can be placed onto the selector to allow for introduction of the leader of the confined paper web through the composite elongated passage 3, 8*a* or 3, 8*b* or 3, 8*c* and on toward and into the chamber 4 where the leader is thereupon clamped or otherwise secured to the threading strip or placed directly into the nip of two advancing rolls. It goes without saying that the selector 8 can be designed to define with the feed table 2 only two different passages or four or more different passages. This merely amounts to a modification of the exact design and number of apertures in the selector 8.

One end portion of the channel 3 is shown in FIG. 1, as at 3A. This end portion registers with the aperture 8*c* (which is an elongated slot) when the selector 8 is moved to the position of FIG. 2. When the selector 8 is moved to the position of FIG. 1, it overlies a part of the end portion 3A so that the effective length of the channel 3 is reduced, i.e., the effective length of the channel suffices to admit a web of medium width. When the selector 8 is moved to the left-hand end position, it overlies the entire end portion 3A of the channel 3 so that the effective length of the channel is reduced still further, i.e., the effective length suffices to allow for introduction of a relatively narrow web into the chamber 4. FIG. 3 shows that each selector 8 can overlie, either in part or entirely, both end portions 3A of the respective channel 3.

The ledge 7*a* of one of the guide members 7 carries a disengageable detent device for the selector 8. To this end, the just mentioned ledge is provided with a bracket 9 for the pivot pin 10A of a two-armed detent lever 10 which is biased clockwise, as viewed in FIG. 1 or 2, by one or more springs 10B. The right-hand arm of the lever 10 has a projection in the form of a pin 11 which can snap into one of several sockets 12 in the selector 8. When the operator wishes to change the position of the selector 8, the lever 10 is pivoted against the opposition of the biasing means 10B and the slector 8 is shifted to a different position before the lever 10 is released so that the biasing means 10B can cause the projection 11 to enter a different socket 12. There is at least one socket 12 for each position of the selector 8. It goes without saying that the selector 8 can have more than one socket 12 for each of the three positions (and the lever 10 is then provided with more than one projection 11) or that the socket or sockets can be provided in the lever 10 if the projection or projections are provided on the selector 8. The provision of a projection or pin 11 and of the sockets 12 facilitates rapid, convenient and accurate placing and retention of the selector 8 in the desired position. The selector can be provided with suitable indicia, legends or other informative matter which enables an operator to rapidly select an appropriate position for the part 8, i.e., to insure that the passage which is defined by the channel 3 and one of the apertures 8*a*–8*c* has an optimum length for the selected paper web.

The operation:

Prior to placing of a cassette C onto the feed table 2, the attendant disengages (if necessary) the lever 10 from the selector 8 and shifts the latter along the ledges 7*a* to a position in which the corresponding aperture 8*a*, 8*b* or 8*c* registers with the channel 3 so as to establish a passage through which the web in the cassette to be emptied can advance into the chamber 4. FIG. 1 shows that a portion of the aperture or cutout 8*b* is in register with the channel 3; thus, the resulting passage can permit webs having a medium width to enter the chamber 4. As a rule, cassettes for convoluted exposed paper webs have external centering pins or posts which enter complementary holes or bores of the apparatus 1 adjacent to the selector 8 to insure that a cassette which is about to be emptied is properly oriented with respect to the passage. One of the just mentioned pins or posts on a cassette actuates a gate G which normally seals the chamber 4 against entry of light via channel 3 so that the gate G is retracted and the leader of the web can enter the chamber 4. The leader of the confined web extends from the cassette and can be advanced through the unobstructed portion of the channel 3 and the registering aperture 8*b* so that it enters the chamber 4 and can be clamped to the threading strip for transport through the developing machine. When the cassette is empty, it is removed from the position or register with the passage and is replaced with a fresh (loaded) cassette. If the width of the web in the fresh cassette is different, the detent lever 10 is actuated to release the selector 8 and the latter is shifted to move the aperture 8*a* or 8*c* into register with the channel 3 before the fresh cassette is placed into the apparatus 1. The projection 11 of the lever 10 holds the selector 8 against any or against appreciable movement lengthwise of the ledges 7*a* while the contents of a cassette are transferred into the developing machine. The lever 10 is actuated only if the width of the web in a preceding cassette deviates from the width of the web in the next cassette.

The average width of the webs of exposed photographic paper is between 8 and 13 cm. However, many presently known developing machines for photographic paper are set up for the processing of webs having a width of up to and even in excess of 30 cm. In order to define a passage for such relatively wide webs, the apparatus of FIGS. 1 and 2 can be modified in a manner as shown in FIG. 3 wherein two neighboring channels 3 can be caused to communicate so as to form a much longer channel 3'. The apparatus of FIG. 3 is designed for simultaneous withdrawal of webs from as many as four discrete cassettes containing webs of identical width or of different widths. The two median sections of the apparatus of FIG. 3 can be combined to define the aforementioned wide channel 3' consisting of two registering channels 3 plus an intermediate channel portion therebetween. The channel 3' can be divided into two shorter channels 3 by a partition 13 which can be moved to the illustrated operative position in which it is recessed into the feed table 2 so as to fill the median part of the channel 3' whereby the outer parts of the channel 3' constitute two discrete channels 3. The dimensions of such discrete channels 3 match the dimensions of the other two channels 3 shown in FIG. 3. If the apparatus is to process a very wide web, the partition 13 is removed from the operative position whereby the two median channels 3 again form part of a continuous channel 3' whose width may be in the range of 30 cm.

The two central or median selectors 8 of FIG. 3 are designed to insure that they can assume positions in which the entire channel 3' is exposed for admission of the leader of a wide web. To this end, the median selectors 8 are moved to the fully retracted positions (as shown in FIG. 3) so that their front edge faces 8*d* are immediately adjacent to the channel 3'. The edge faces 8*d* preferably slope rearwardly and upwardly from the channel 3' to facilitate the introduction of the leader of a wide web into the channel 3'. The configuration of edge faces bounding the aforediscussed apertures 8*a*–8*c* of the selectors 8 is preferably similar, i.e., such edge faces also slope upwardly and away from the channel 3 or 3' to allow for more convenient introduction and advancement of the leader of a web into and through the respective passage. Still further, similarly inclined edge faces are provided or may be provided on the guide members 5 adjacent to the respective channels 3 and 3'.

In all other respects, the composite apparatus of FIG. 3 is identical with or analogous to the apparatus of FIGS. 1 and 2. Thus, the apparatus of FIG. 3 also comprises detent levers 10, one for each selector 8, and each selector 8 has several apertures 8*a*–8*c* so as to enable the corresponding channel 3 to define (with the aperture 8*a*, 8*b* or 8*c*) a passage of requisite length.

Referring again to FIGS. 1 and 2, the selector 8 may be provided with holes or bores 14 which register with certain bores or holes 15 in the feed table 2 in each of the three predetermined positions of the selector. The cassettes have pins or posts whose positions are indicative of the width of confined webs therein, and such pins or posts can enter the registering holes 14 and 15 only if the selector 8 is properly positioned, i.e., if the selector cooperates with the feed table 2 to define a passage having an optimum length for introduction of the corresponding web into the chamber 4. In other words, the just discussed posts on the cassettes and the holes 14, 15 prevent the attendant from positioning a cassette on the feed table 2 if the width of the web which is confined in such cassette does not correspond to the length of the selected passage including the channel 3 and the aperture 8*a*, 8*b* or 8*c*. The just discussed post or posts of a cassette may also perform the function of the previously mentioned centering pin or pins and of the means for moving the gate G from the channel 3 so that the leader of a web can be introduced into the chamber 4. In other words, the holes 14, 15 and the corresponding post or posts of each cassette constitute a safety feature which further reduces the likelihood of adequately mounting a cassette in optimum position for withdrawal of its web when the length of the passage is not satisfactory for advancement of such web into the chamber 4 and thence through the tanks of the developing machine.

It is also possible to install electric switches in the holes or bores 15. When the length of the passage is satisfactory a properly mounted cassette causes its post to actuate the switch in the corresponding hole 15 and to thus initiate the generation of a visible and/or audible signal which informs the attendant that the cassette is ready, i.e., that the attendant can thread the leader of the confined web through the passage 3' or 3, 8*a* or 3, 8*b* or 3, 8*c* and into the chamber 4 for attachment to a threading strip (in a manner as disclosed in U.S. Pat. No. 4,067,034) or for introduction into the nip of two advancing rolls.

An important advantage of the improved apparatus is that the effective length of a channel 3 or 3' can be changed with little loss in time and with a minimum of effort. Moreover, the attendant can immediately ascertain the position of the selector or selectors so as to insure that the chosen length of the passage is best suited for introduction of the leader of the web in that cassette which is about to be placed onto the feed table 2. Still further, and to even more positively insure that the cassette can be properly positioned only if the selected length of the passage is appropriate, the apparatus comprises the aforementioned holes 14 and 15 which cooperate with the post or posts of the selected cassette to guarantee that the cassette cannot be mounted in requisite position unless the length of the passage is appropriate for the introduction of the leader of such cassette into the chamber 4. It is also possible to provide the selector(s) and/or the feed table 2 and/or the guide members with multicolored or other indicia (e.g., letters, groups of letters, numerals or groups of numerals) to further facilitate immediate determination of the position of each selector.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the claims.

We claim:

1. In a photographic developing machine, particularly for developing webs of exposed photographic paper which have different widths and are confined in cassettes, an apparatus for positioning cassettes preparatory to withdrawal of webs from their interior, said apparatus comprising a feed table having at least one channel; means defining a chamber disposed at one side of said table and communicating with said channel; and a substantially plate-like selector adjacent to the other side of said table and having a plurality of differently dimensioned apertures, said selector being movable between a plurality of positions in each of which a different aperture registers with said channel to define therewith a passage through which a web having one of several different widths can be advanced from the interior of a cassette into said chamber.

2. The apparatus of claim 1, further comprising means for preventing the penetration of light into said chamber via said channel in the absence of a cassette in register with said channel.

3. The apparatus of claim 1, further comprising guide means provided on said table and arranged to confine said selector to movements in predetermined directions.

4. The apparatus of claim 1, wherein said channel is elongated and has a predetermined width, said apertures including a slot having a width at least approximating said predetermined width.

5. The apparatus of claim 1, wherein said channel has a predetermined length and said selector overlies a portion of said channel in at least one of said positions thereof so as to thereby shorten the effective length of said channel.

6. The apparatus of claim 1, wherein at least one of said apertures is a cutout in said selector.

7. The apparatus of claim 1, wherein said selector has at least one edge face adjacent to and sloping outwardly from one of said apertures.

8. The apparatus of claim 7, wherein said channel is elongated and said edge face is adjacent to one side of said elongated channel when the latter registers with said one aperture.

9. The apparatus of claim 1, further comprising detent means for releasably holding said selector in any one of said positions thereof.

10. The apparatus of claim 9, wherein said detent means comprises a detent member movably secured to said feed table and having at least one projection, said selector having a plurality of sockets, at least one for each of said positions, said projections being insertable into a socket when the corresponding aperture of said selector registers with said channel.

11. The apparatus of claim 1, further comprising means for identifying said positions of said selector.

12. The apparatus of claim 11, wherein said identifying means comprises at least one first hole in said selector and several second holes in said feed table, at least one for each of said positions, said first hole being aligned with a different second hole in each position of said selector.

13. The apparatus of claim 1, further comprising a second selector and a partition movable to and from an operative position in which it overlies a median part of said channel, said selectors being disposed at the opposite sides of said partition and each thereof fully exposing the adjacent portion of said channel in one of said positions thereof so that the entire channel is exposed when said partition is removed from said operative position and each of said selectors assumes said one position.

* * * * *